US010665935B2

(12) United States Patent
Wu et al.

(10) Patent No.: US 10,665,935 B2
(45) Date of Patent: May 26, 2020

(54) OUT-OF-BAND COUPLED ANTENNA COMBINED BY FINE-AND-STRAIGHT ANTENNA AND BOW-TIE ANTENNA

(71) Applicant: BEIHANG UNIVERSITY, Beijing (CN)

(72) Inventors: Qi Wu, Beijing (CN); Donglin Su, Beijing (CN)

(73) Assignee: BEIHANG UNIVERSITY, BeiJing (CN)

( * ) Notice: Subject to any disclaimer, the term of this patent is extended or adjusted under 35 U.S.C. 154(b) by 513 days.

(21) Appl. No.: 15/634,995

(22) Filed: Jun. 27, 2017

(65) Prior Publication Data

US 2017/0294710 A1 Oct. 12, 2017

(30) Foreign Application Priority Data

Jun. 27, 2016 (CN) ..... 2016 1 0481737

(51) Int. Cl.

| | |
|---|---|
| ***H01Q 9/06*** | (2006.01) |
| ***H01Q 1/52*** | (2006.01) |
| ***H01Q 9/00*** | (2006.01) |
| ***H01Q 1/36*** | (2006.01) |
| ***H01Q 9/28*** | (2006.01) |

(52) U.S. Cl.

CPC ..... *H01Q 1/521* (2013.01); *H01Q 1/36* (2013.01); *H01Q 9/005* (2013.01); *H01Q 9/065* (2013.01); *H01Q 9/28* (2013.01)

(58) Field of Classification Search

CPC ..... H01Q 1/36; H01Q 1/521; H01Q 9/065; H01Q 9/0407; H01Q 9/28; H01Q 1/38

See application file for complete search history.

(56) References Cited

U.S. PATENT DOCUMENTS

| | | | | |
|---|---|---|---|---|
| 8,884,834 | B1 * | 11/2014 | Paschen | H01O 9/28 343/795 |
| 2004/0017325 | A1 * | 1/2004 | Satoh | H01Q 1/38 343/795 |
| 2009/0124215 | A1 * | 5/2009 | Nysen | H01Q 1/2275 455/90.1 |
| 2018/0212329 | A1 * | 7/2018 | Takahashi | H01Q 1/246 |

* cited by examiner

*Primary Examiner* — Dameon E Levi
*Assistant Examiner* — Hasan Z Islam

(57) ABSTRACT

An out-of-band coupled antenna combined by fine-and-straight antenna and bow-tie antenna is provided, including: a dielectric slab (1), an AA radiation element (2) provided on an upper plate (1A) of the dielectric slab (1) by a, a cooper pouring process, a BA radiation element (3), an A feeder line (4) and a B feeder line (5); an AB radiation element (8) provided on a lower plate (1B) of the dielectric slab (1), a BB radiation element (9), a C feeder line feeder (6) and a D feeder line (7); a first sensor (10A) and a second sensor (10B) which are connected on the AA radiation element (2); a third sensor (10C) and a fourth sensor (10D) which are connected on the AB radiation element (8). The antenna is capable of suppressing out-of-band coupling between indication elements to improve the separation degree.

8 Claims, 8 Drawing Sheets

Fig. 4A
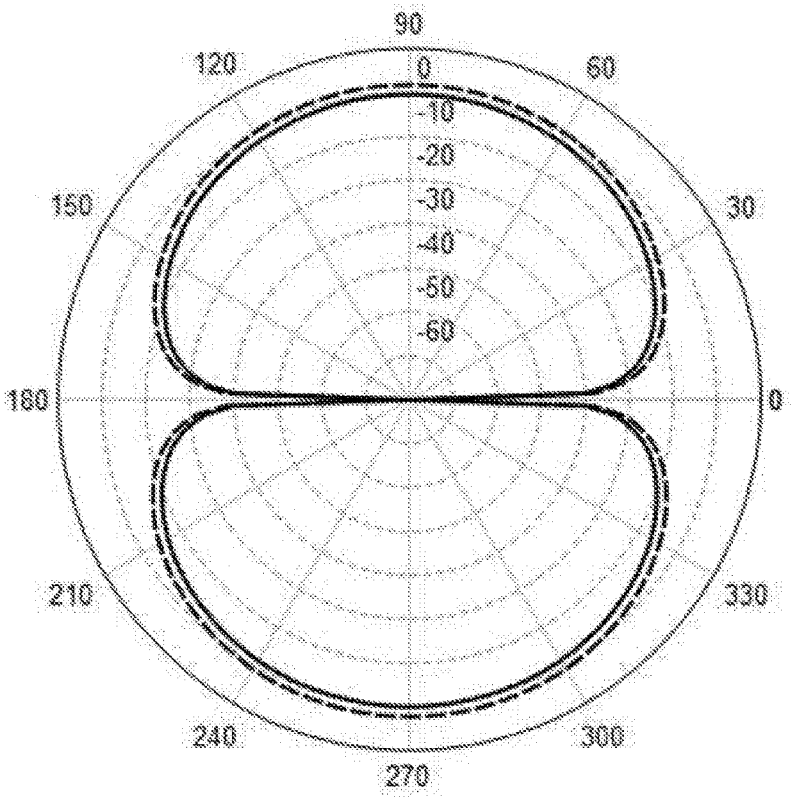
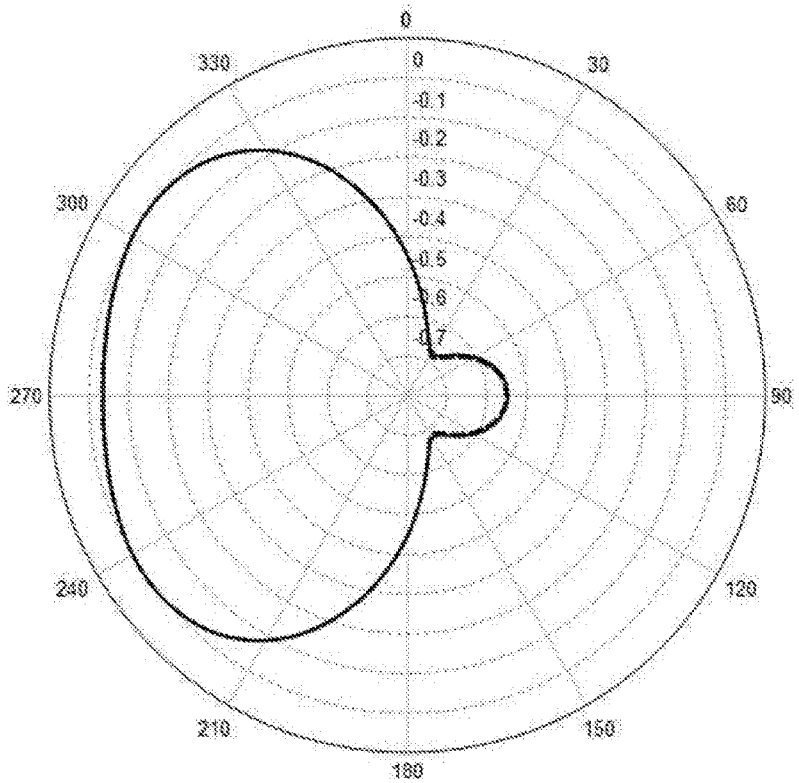
Fig. 4B

OUT-OF-BAND COUPLED ANTENNA COMBINED BY FINE-AND-STRAIGHT ANTENNA AND BOW-TIE ANTENNA

CROSS REFERENCE OF RELATED APPLICATION

The present application claims priority under 35 U.S.C. 119(a-d) to CN 201610481737.9, filed Jun. 27, 2016.

BACKGROUND OF THE PRESENT INVENTION

Field of Invention

The present invention relates to an out-of-band coupling suppression antenna and more particularly to a combined antenna for multiplying a fine-and-straight antenna and a bow-tie antenna.

Description of Related Arts

At present, due to the characteristics of the capacity of keeping a good balance of instantaneous bandwidth, signal conformal, effective radiation and other aspects, bow-tie antennas are widely applied in antennas radiated by narrow pulse signals. In addition, since the bow-tie antenna is light easy to manufacture, it also has important application in other fields. With the rapid development of science and technology and the popularity of broadband communication equipments, the broadband technology of the antennas is also developing constantly. With the increase in frequency and the shortcutting of the wavelength, the economic advantages of the quarter-wavelength antenna gradually appear and people's requirements on the antenna broadband are gradually increased. Bandwidth methods and computer-based optimization methods have all achieved excellent performance. With the widely research on the broadband antenna research, its technology is gradually maturing. However, the wideband and miniaturization of the antenna is still a traditional trend. It is hoped that the stability and high gain of the directional diagrams are improved as well while achieving wideband and miniaturization, so as to improve the communication quality and the anti jamming capability more effectively.

With the broadband antenna research has becoming a hot spot, the out-of-band coupled problem thereof gradually appears. The antenna analysis methods mainly include the analytic method and the numerical method. The analytic method includes the separation variable method, the orthogonal function expansion method, the mirror method, the Green function method and so on, which all have a clear physical picture and are capable of obtaining the exact solution, but are only capable of solving simple problems. The numerical method includes the difference method, Domain finite difference method (FDTD), moment method (MOM), finite element method (FEM) and so on, which not only solves the electromagnetic problem of complex shape solving domain, but also has a fast calculation speed and a wide application range to give the exact solution to the engineering problem, but cannot explain the object from the physical mechanism, and thus is not suitable for designing the antenna according to specific requirements.

The characteristic mode theory based on the method of moments can decompose the resonant state of the conductor surface into a family characteristic mode, and their corresponding eigencurrents are orthogonal to the source region, and their characteristic field is orthogonal to the infinite spherical surface. The characteristic mode theory is only related to the structure, size and operating frequency of the antenna, and is not limited by the feed position or the feed mode. Therefore, when the theory of characteristic mode is used in the analysis and design of the antenna, it is usually superior to the traditional design formula or pure numerical method. Since the characteristic modes of each order are independent of external excitation, they are the unique properties of the conductor surface and only related with the shape and size of the conductor. Therefore, the process of using the characteristic mode analysis designed antenna can be divided into two steps, wherein a first step is to determine the shape and size of the radiation unit, which is for designing the antenna to meet the expected radiation properties and operating frequency; and the second step is to select the appropriate incentive configuration to inspire the desired mode, wherein only by the appropriate incentives, can the plurality if characteristic mode required be inspired to meet the requirements of design. The characteristic mode analysis takes advantages of analytic and momentary methods into account, not only overcomes the shortcomings of analytic for being used for calculating the boundary value of arbitrary surface shape, but also overcomes the shortcomings of conventional numerical methods. The characteristic mode analysis has a distinct physical concept and is easy to understand, master and utilize.

For the broadband antenna, when the load suppression is carried out on the bow-tie antenna by using the characteristic mode analysis, since the current distribution of the bow-tie antenna is distributed over the entire antenna and variation of the current distribution cannot be achieved by loading at a certain position, thus its non-operation mode cannot be suppressed, so the conventional method fails.

It is hoped that the requirements such as the stability and high gain of the pattern will be improved while the broadband and miniaturization are achieved, and the demand is improved more effectively Communication quality and anti jamming capability.

SUMMARY OF THE PRESENT INVENTION

In order to solve the problem of suppressing an electromagnetic coupling between antennas with non-coincide operating frequency, the present invention designs an out-of-band coupling antenna combined by a fine-and-straight antenna and a bow-tie antenna. By loading inductance on an ideation element of the bow-tie antenna, the antenna improves a degree of separation between the fine-and-straight antenna and the bow-tie antenna, and suppresses out-of-band coupling between the fine-and-straight antenna and the bow-tie antenna.

The present invention provides an out-of-band coupled antenna combined by a fine-and-straight antenna and a bow-tie antenna, comprising: a dielectric slab (1), an AA radiation element (2); an AB radiation element (8), a BA radiation element (3), a BB radiation element (9), an A feeder line (4), a B feeder line (5), a C feeder line (6), a D feeder line (7), a first sensor (10A), a second sensor (10B), a third sensor (10C) and a fourth sensor (10D);

wherein the AA radiation element (2) and the AB radiation element (8) have an identical structure with each other and form the bow-tie antenna;

wherein the BA radiation element (3) and the BB radiation element (9) have an identical structure with each other and form the fine-and-straight antenna;

wherein the AA radiation element (2), the BA radiation element (3), the A feeder line (4), the B feeder line (5) are provided on the upper plate (1A) of the dielectric slab (1) by a cooper covering technique; wherein a cooper covering thickness thereof is 0.018-0.035 mm;

wherein the AB radiation element (8), the BB radiation element (9), the C feeder line (6) and the D feeder line (7) are provided on a lower plate (1B) of the dielectric slab (1), wherein a cooper covering thickness thereof is 0.018-0.035 mm;

wherein an A isolation groove (2A) is provided on the AA radiation element (2), the A isolation groove (2A) does not have a cooper covering layer; a first sensor (10A) and a second sensor (10B) are respectively provided on two ends of the A isolation groove (2A);

wherein a B isolation groove (8A) is provided on the AB radiation element (8), the B isolation groove (8A) does not have a cooper covering layer; a third sensor (10C) and a fourth sensor (10D) are respectively provided on two ends of the B isolation groove (8A);

In the present invention, the A isolation groove (2A) and the B isolation groove (8A) are respectively provided on a three-quarter distance between an upper bottom edge and a lower bottom edge of the AA radiation element (2) and the AB radiation element (8). The out-of-band coupled antenna has a wavelength at a range of 50 mm-5000 mm as a size constraint.

The out-of-band coupled antenna of the present invention combined by the fine-and-straight antenna and bow-tie antenna has following beneficial effects.

(1) In the present invention, loading inductance on a suitable position of the radiation element of the bow-tie antenna is capable of improving a degree of separation of two kinds of antennas and effectively suppressing mutual coupling.

(2) The out-of-band coupled antenna combines the fine-and-straight antenna and bow-tie antenna, so as to obtain a wide operating frequency, which has a wider application range.

(3) By manufacturing a cooper covering layer with gaps, i.e., separation grooves, the present invention solves problems that current loading fail to pass through the inductance.

(4) Changing a size of the antenna is capable of regulating suppressing frequency of the combined antenna, and a manufacture method thereof is simple.

These and other objectives, features, and advantages of the present invention will become apparent from the following detailed description, the accompanying drawings, and the appended claims.

BRIEF DESCRIPTION OF THE DRAWINGS

FIG. 4A is an E-direction view of the antenna with the size of the Embodiment 1.

FIG. 4B is an H-direction view of the antenna with the size of the Embodiment 1.

| | | |
|---|---|---|
| 1. dielectric slab | 1A-upper plate | 1B-lower plate |
| 2-AA radiation element | 2A-A isolation groove | 3-BA radiation element |
| 4-A feeder line | 5-B feeder line | 6-C feeder line |
| 7-D feeder line | 8-AB radiation element | 8A-B isolation groove |
| 9-BB radiation element | 10A-A inductor | 10B-B sensor |
| 1OC-C sensor | 10D-D sensor | 20-AC radiation element |
| 80-AD radiation element | | |

DETAILED DESCRIPTION OF THE PREFERRED EMBODIMENT

Further description of the present invention is illustrated combining with the preferred embodiments and the accompany drawings.

Figure 1:
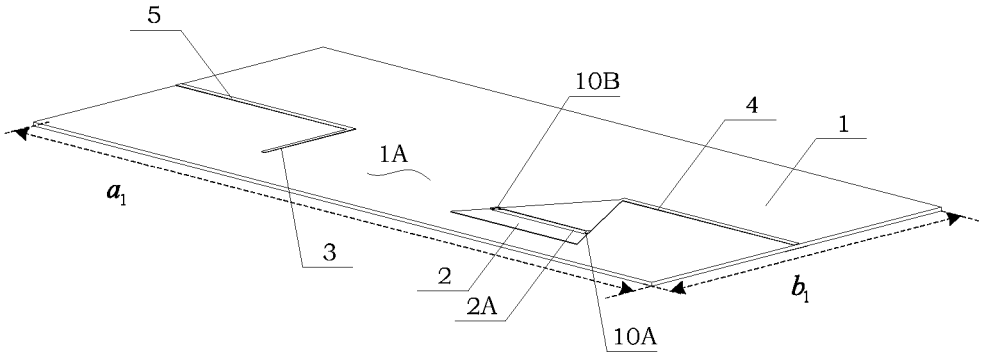
FIG. 1 is a structural sketch view of an upper plate of a wide-band bow-tie antenna utilizing inductance load to suppress out-of-band coupling.
Figure 1A:
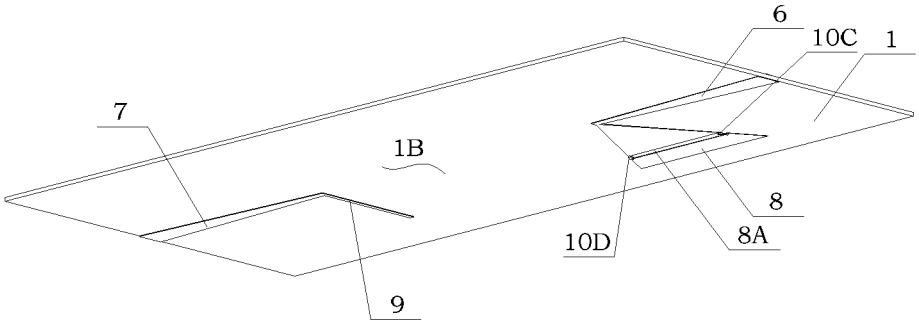
FIG. 1A is a structural view of a lower plate of the wide-band bow-tie antenna utilizing inductance load to suppress out-of-band coupling.
Figure 2:
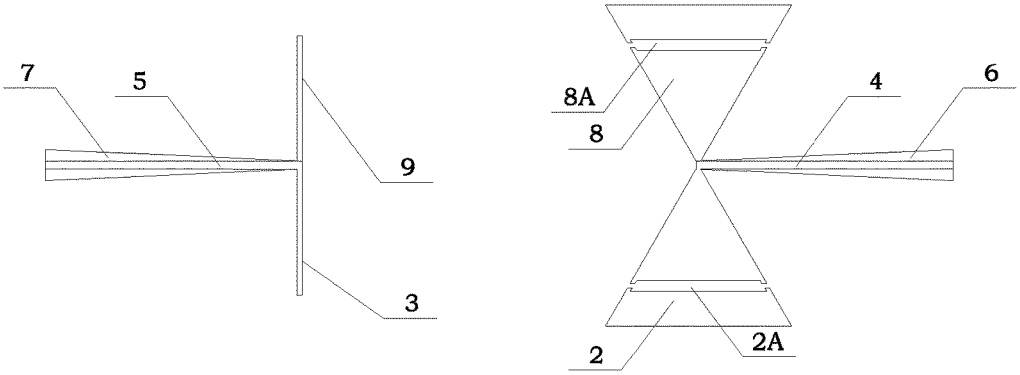
FIG. 2 is a first front view of a radiation element of the present invention.
Figure 2A:
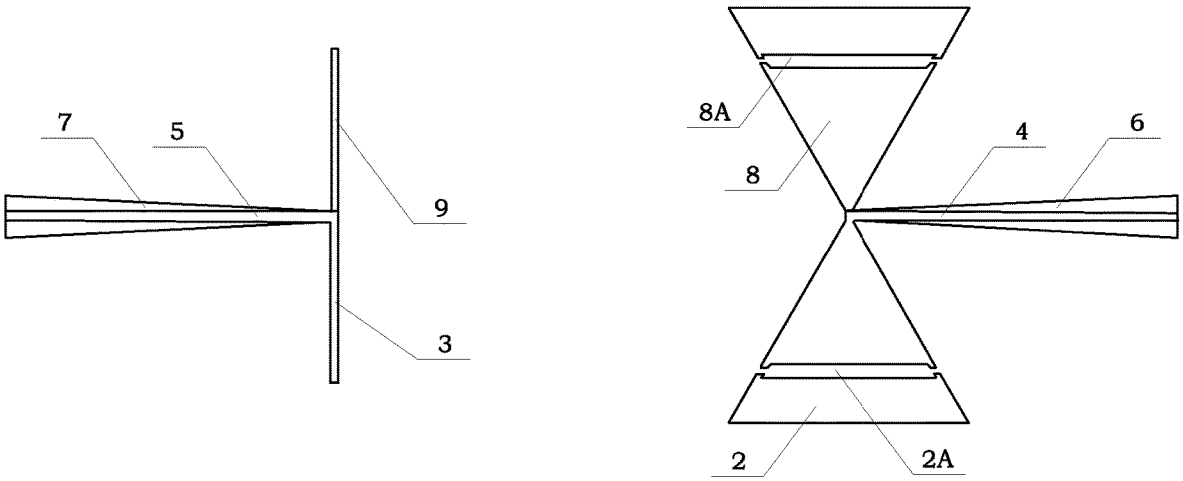
FIG. 2A is a first front view of a radiation element of the present invention.

Referring to FIG. 1, as shown in FIG. 1A, the present invention designs an out-of-band coupled antenna combined by a fine-and-straight antenna and a bow-tie antenna, comprising: a dielectric slab 1, an AA radiation element 2; an AB radiation element 8, a BA radiation element 3, a BB radiation element 9, an A feeder line 4, a B feeder line 5, a C feeder line 6, a D feeder line 7, a first sensor 10A, a second sensor 10B, a third sensor 10C and a fourth sensor 10D. The AA radiation element 2 and the AB radiation element 8 have an identical structure with each other and form the bow-tie antenna (See FIG. 2 and FIG. 2A). The BA radiation element 3 and the BB radiation element 9 have an identical structure with each other and form the fine-and-straight antenna (See FIG. 2 and FIG. 2A).

A feeding mode of the out-of-band coupled antenna combined by the fine-and-straight antenna and the bow-tie antenna is side-fed.

In the present invention, the first sensor 10A, the second sensor 10B, the third sensor 10C and the fourth sensor 10D all adopt LQW18AN_00 series sensors manufactured by Murata Corporation of Japan. A value the first sensor 10A, the second sensor 10B, the third sensor 10C and the fourth sensor 10D is at a range of 2.2 nH-120 nH.

The AA radiation element 2, the BA radiation element 3, the A feeder line 4, the B feeder line 5 are provided on the upper plate 1A of the dielectric slab 1 by a cooper covering technique; wherein a cooper covering thickness thereof is 0.018-0.035 mm.

The AB radiation element 8, the BB radiation element 9, the C feeder line 6 and the D feeder line 7 are provided on a lower plate 1B of the dielectric slab 1, wherein a cooper covering thickness thereof is 0.018-0.035 mm.

In the present invention, the AA radiation element 2 is in a shape of a trapezoidal, and more particularly, an isosceles trapezoidal. An isolation groove 2A is provided on the AA radiation element 2 by a cutting process, the A isolation groove 2A does not have a cooper covering layer; a first sensor 10A and a second sensor 10B are respectively provided on two ends of the A isolation groove 2A (See FIG. 1). The A isolation groove 2A is provided on a three-quarter distance between an upper bottom edge and a lower bottom edge of the AA radiation element 2, i.e., $b_{2cut}=\frac{3}{4}b_2$, wherein $b_{2cut}$ represents a distance between the upper bottom edge and the A isolation groove 2A, which is named a cutting position of the A isolation groove 2A; $b_2$ represents a distance between the upper bottom edge and the lower bottom edge of the AA radiation element 2.

As shown in FIG. 1, a length of the dielectric slab 1 is denoted as $a_1$, a width of the dielectric slab 1 is denoted as $b_1$ and a thickness of the dielectric slab 1 is at a range of 0.5-1.5 mm.

Figure 2B:
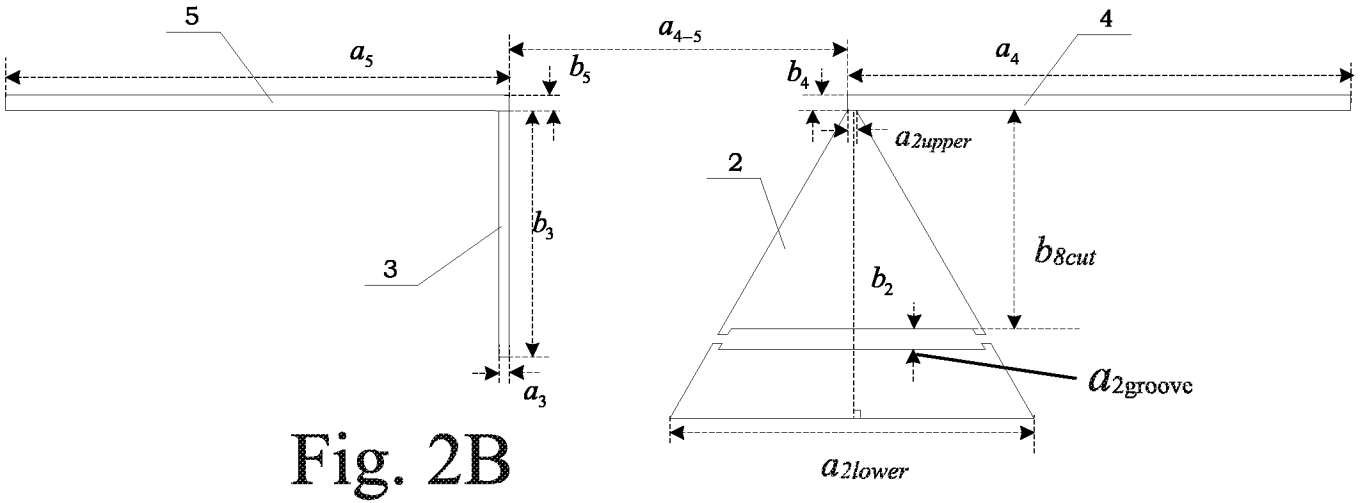
FIG. 2B is a size marking sketch view of radiation elements which are on a middle and upper portion.
Figure 2C:
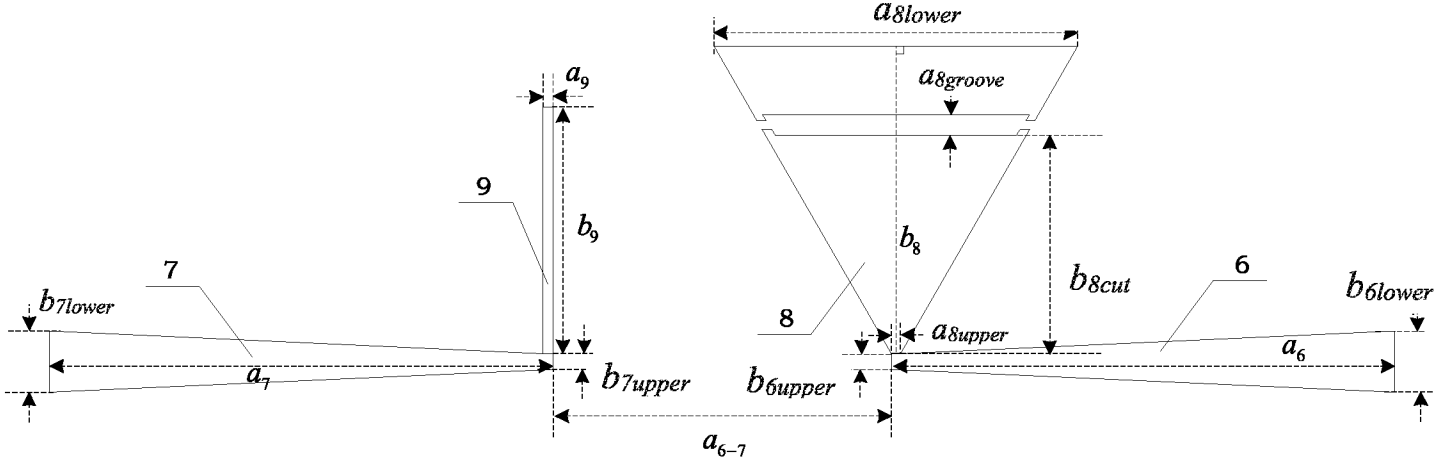
FIG. 2C is a size marking sketch view of radiation elements which are on a middle and lower portion.

As shown in FIG. 2B, a length of the lower bottom edge of the AA radiation element 2 is denoted as $a_{2lower}$; a length of the upper bottom edge of the AA radiation element 2 is denoted as $a_{2upper}$; a distance between the upper bottom edge and the lower bottom edge of the AA radiation element 2 is denoted as $b_2$; a width of the A isolation groove 2A of the AA radiation element 2 is denoted as $a_{2groove}$, and a cutting position of the A isolation groove 2A is denoted as $b_{2cut}$.

As shown in FIG. 2B, a length of the BA radiation element 3 is denoted as $a_3$, and a width of the BA radiation element 3 is denoted as $b_3$.

As shown in FIG. 2B, a length of the A feeder line 4 is denoted as $a_4$; and a width of the A feeder line 4 is $b_4$.

As shown in FIG. 2B, a length of the B feeder line 5 is denoted as $a_5$, a width of the B feeder line 5 is denoted as $b_5$; and an opposite distance between the A feeder line 4 and the B feeder line 5 is denoted as $b_{4\text{-}5}$.

As shown in FIG. 2B, a length of the lower bottom edge of the AB radiation element 8 is denoted as $a_{8lower}$; a length of the upper bottom edge of the AB radiation element 8 is denoted as $a_{8upper}$; a distance between the upper bottom edge and the lower bottom edge of the AB radiation element 8 is denoted as $b_8$; a width of the B isolation groove 8A on the AB radiation element 8 is denoted as $a_{8groove}$, and a cutting position of the B isolation groove 8A is denoted as $b_{8cut}$.

As shown in FIG. 2B, a length of the BB radiation element 9 is denoted as $a_9$, and a width of the BA radiation element 3 is denoted as $b_9$.

As shown in FIG. 2B, a length of the C feeder line 6 is denoted as $a_6$; and a width of an upper bottom edge of the C feeder line 6 is denoted as $b_{6upper}$; and a width of the lower bottom edge of the C feeder line 6 is denoted as $b_{6lower}$.

As shown in FIG. 2B, a length of the D feeder line 5 is denoted as $a_7$, a width of an upper bottom edge of the D feeder line 7 is denoted as $b_{7upper}$, a width of a lower bottom edge of the D feeder line 7 is denoted as $b_{7lower}$. An opposite distance between the C feeder line 6 and the D feeder line 7 is denoted as $b_{6\text{-}7}$.

Size Constraint of Configuration of Cooper Pour

In the present invention, considering practical application scene of the antenna, a wavelength at a range of 50 mm-5000 mm serves as a size constraint of the antenna:

$a_1=(0.8\sim1.5)\ \lambda$, $b_1=(0.4\sim0.8)\ \lambda$;

$a_{2upper}=a_{8upper}=(0.005\sim0.01)\ \lambda$, $a_{2lower}=a_{8lower}=1.15\ b_2$, $b_2=b_8=(0.1\sim0.2)\ \lambda$, $a_{2groove}=a_{8groove}=(0.005\sim0.01)\ \lambda$, $b_{2cut}=\frac{3}{4}\ b_2$, $b_{8cut}=\frac{3}{4}\ b_8$;

$a_3=a_9=(0.005\sim0.01)\ \lambda$, $b_3=b_9=(0.2\sim0.3)\ \lambda$;

$a_4=a_5=a_6=a_7=(0.25\sim0.5)\ \lambda$;

$b_4=b_5=b_{6upper}=b_{7upper}=0.0075\lambda$;

$b_{7lower}=b_{6lower}=0.03\lambda$;

$b_{4\text{-}5}=b_{6\text{-}7}=(0.3\sim0.5)\ \lambda$.

Embodiment 1

A thickness of cooper pouring of the radiation elements and the feeder lines manufactured by a cooper pouring technique is 0.0035 cm. In the Embodiment 1, a size of the dielectric slab is: $a_1=175$ cm, $b_1=82$ cm; and a height of the dielectric slab is 0.08 cm.

A size of the fine-and-straight antenna in the Embodiment 1 is: $a_3=a_9=1$ cm, $b_3=b_9=43$ cm, $a_5=a_7=50$ cm, $b_5=b_{7upper}=1.5$ cm and $b_{7lower}=6$ cm.

In the embodiment 1, a size of the bow-tie antenna, i.e., the AA radiation element 2 and the AB radiation element 8 are in cooper pouring configuration of isosceles trapezoidal, is: $a_4=a_6=50$ cm, $b_4=b_{6upper}=1.5$ cm, $b_{6lower}=6$ cm, $a_{2upper}=a_{8upper}=1$ cm, $a_{2lower}=a_{8lower}=35.6$ cm, $b_2=b_8=31$ cm, $a_{2groove}=a_{8groove}=2$ cm. The cutting position of the A isolation groove 2A is on three quarters of $b_2$, i.e., 23.25 cm. The cutting position of the B isolation groove 8A is on three quarters of $b_8$, i.e., 23.25 cm.

In the Embodiment 1, S-parameter is utilized for performance evaluation in. Dotted line in the Figure represents a conventional antenna wherein inductance is not loaded on the AA radiation element 2 and the AB radiation element 8. The solid lines represent the antennas designed in the Embodiment 1.

Figure 3A:
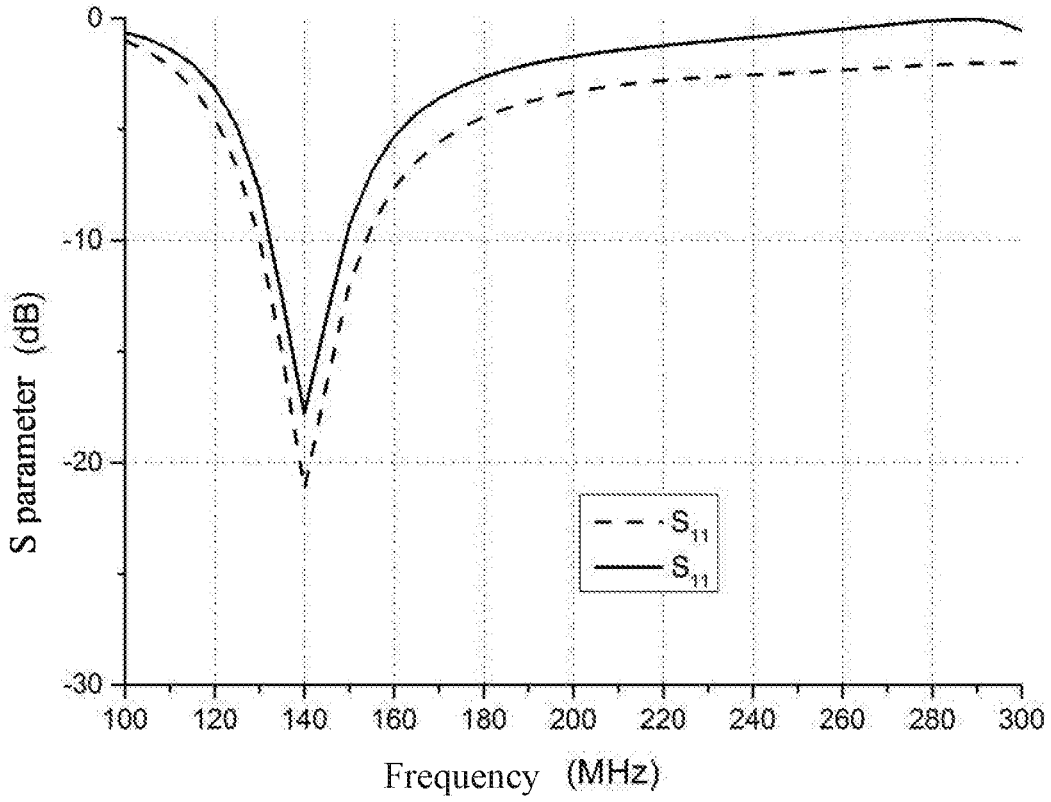
FIG. 3A is an S11 parameter diagram of an antenna with a size of the Embodiment 1.

As shown in FIG. 3A, the parameter S11 represents the operation performance of the bow-tie antenna, wherein the performance before and after loading the inductance and at a working frequency of 140 MHz is not changed.

Figure 3B:
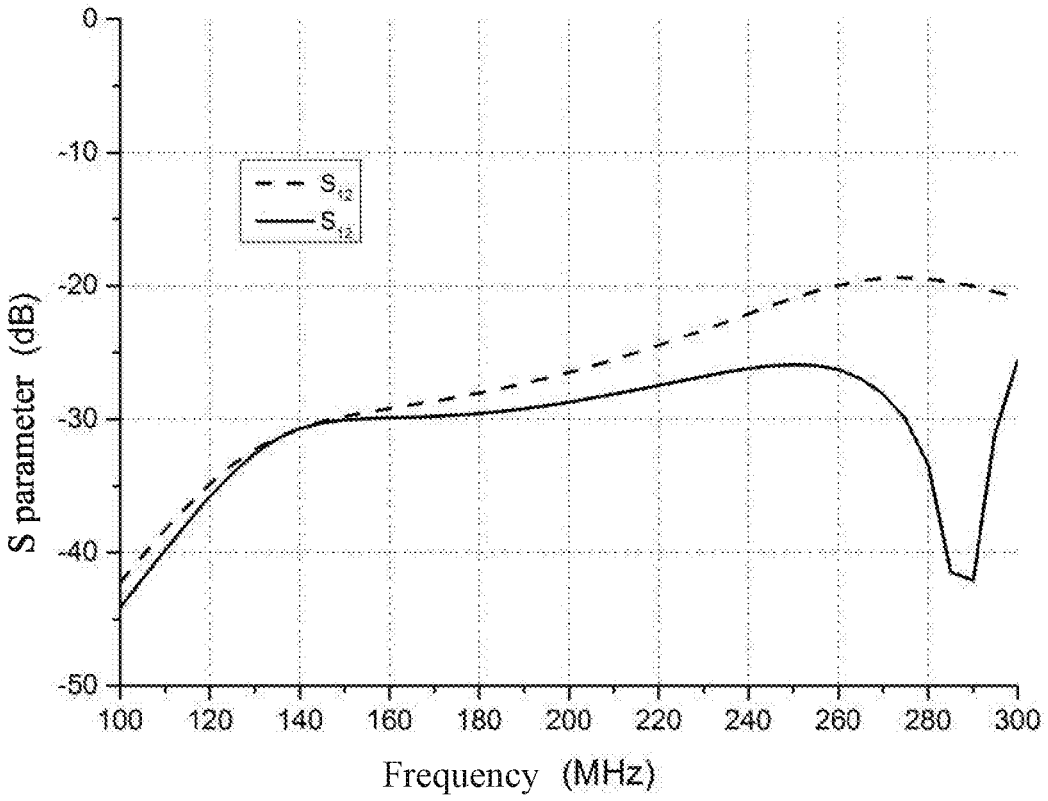
FIG. 3B is an S12 parameter diagram of an antenna with the size of the Embodiment 1.

As shown in FIG. 3B, the present invention uses S12 to evaluate the isolation degree between the bow-tie antenna and the fine-and-straight antenna. As shown in FIG. 3B, coupling degree of the conventional antenna under a working frequency is −19 dB. However, in the Embodiment 1, the coupling degree is reduced to −30 dB, with a 11 dB decline. Coupling degree S12 at a frequency of 290 MHz is suppressed by over 20 dB.

Figure 3C:
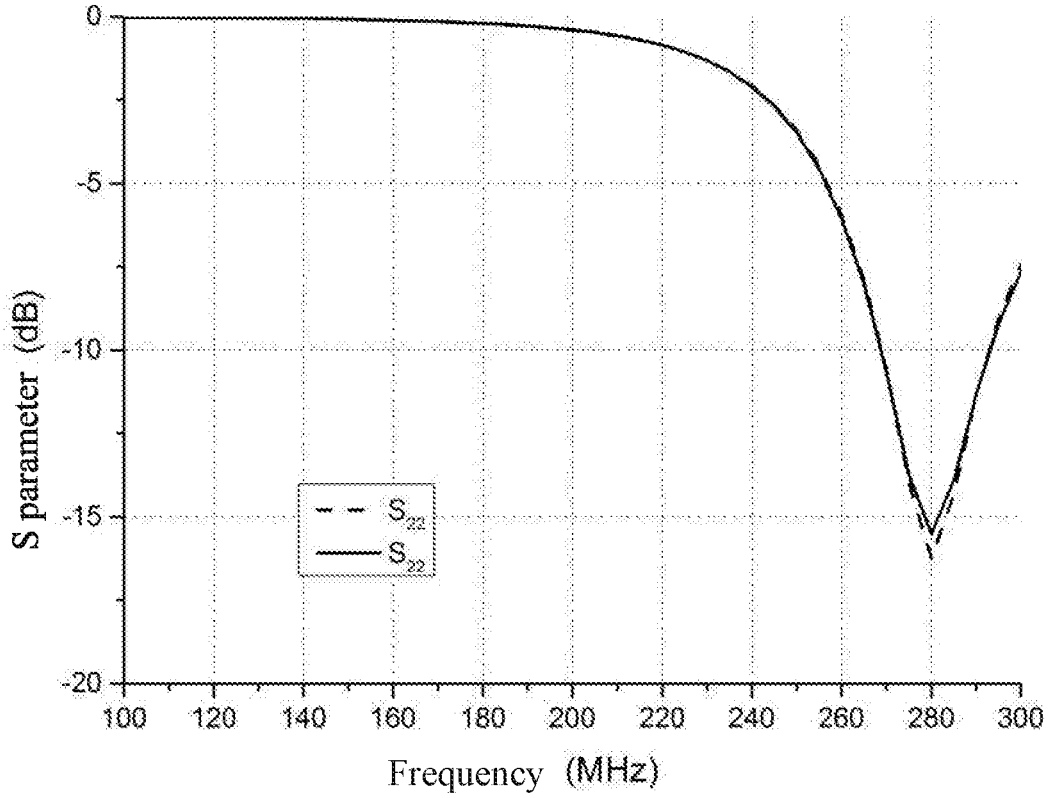
FIG. 3C is an S22 parameter diagram of an antenna with the size of the Embodiment 1.

As shown in FIG. 3C, parameter S22 represents working performance of the fine-and-straight antenna, the performance of S22 is basically un-changed before and after loading the inductance at a working frequency of 280 MHz.

Performance evaluation is performed on the Embodiment 1 before and after loading the inductive by a directional diagram. The dotted lines in the Figs represent a conventional antenna, and the solid line represents the antenna designed in the Embodiment 1. It can be seen from the E-plane diagram of the FIG. 4A that: under a working frequency of 140 MHz, the radiation performance of the E-plane antenna is not influenced. It can be seen from the H-plane directional diagram of the FIG. 4B that the radiation performance of the H-plane antenna is not influenced at a working frequency of 140 MHz.

Figure 5:
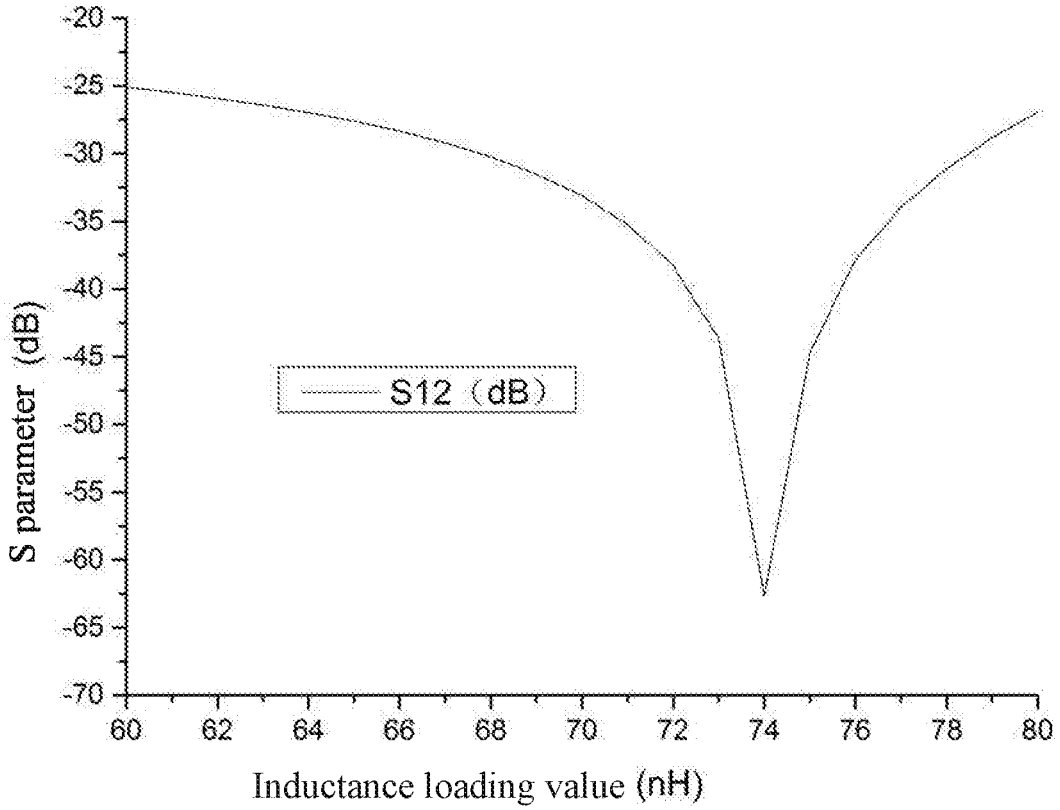
FIG. 5 is a S12 parameter view of the antenna with the size of the Embodiment 1 with different inductance loading values.

In the Embodiment 1 of the present invention, at the working frequency of 280 MHz, the variation curve of the S12 with the loading inductance is as shown in FIG. 5, wherein at a point with an inductance of 74 nH, mutual coupling is significantly suppressed, and S12 is the optimum.

Embodiment 2

Figure 6:
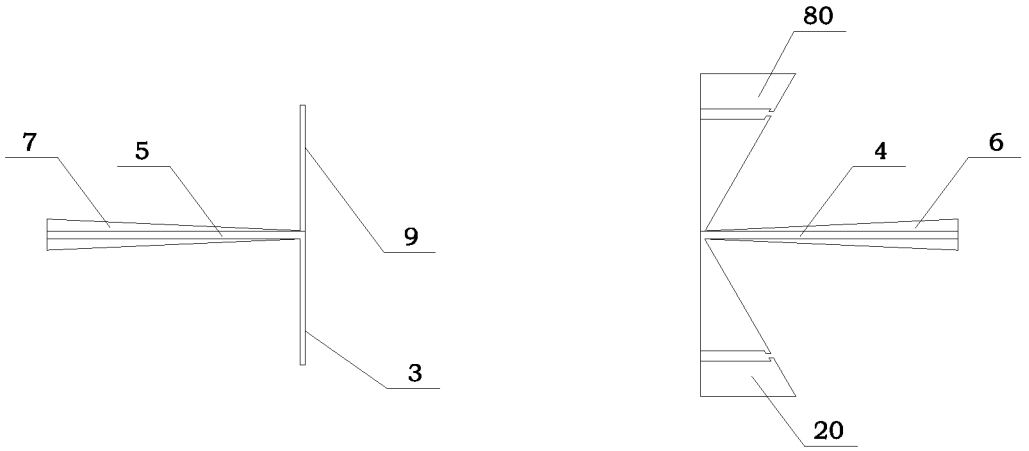
FIG. 6 is a front view of another radiation element part of the present invention.

A thickness of cooper pouring of the radiation elements and the feeder lines manufactured by a cooper pouring technique is 0.0035 cm. Structural size of the Embodiment 2 is identical to the Embodiment 1, and the only difference lies in the shape of the trapezoidal of the bow-tie antenna, i.e., the shape of the trapezoidal of the AC radiation element 20 and the AD radiation element 80 has a cathetus and a bevel edge (See FIG. 6).

In the Embodiment 2, S-parameter is utilized for performance evaluation in. Dotted line in the Figure represents a conventional antenna wherein inductance is not loaded on the AC radiation element 20 and the AD radiation element 80. The solid lines represent the antennas designed in the Embodiment 2.

The parameter S11 represents the operation performance of the bow-tie antenna, wherein the performance before and after loading the inductance and at a working frequency of 200 MHz is not basically changed.

The present invention uses S12 to evaluate the isolation degree between the bow-tie antenna and the fine-and-straight antenna. Coupling degree of the conventional antenna under a working frequency is −12 dB. However, in the Embodiment 2, the coupling degree is reduced to −20 dB, with a 8 dB decline.

In the present invention, parameter S22 represents working performance of the fine-and-straight antenna, and the performance of S22 is basically un-changed before and after loading the inductance at a working frequency of 280 MHz.

Performance evaluation is performed on the Embodiment 2 before and after loading the inductive by a directional diagram. The dotted lines in the Figs represent a conventional antenna, and the solid line represents the antenna designed in the Embodiment 2. It can be seen from the E-plane diagram that: under a working frequency of 200 MHz, the radiation performance of the E-plane antenna is not influenced.

In the Embodiment 2, at a point with an inductance of 68 nH, mutual coupling is significantly suppressed, and S12 is the optimum.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An out-of-band coupled antenna combined by a fine-and-straight antenna and a bow-tie antenna, comprising: a dielectric slab, an AA radiation element; an AB radiation element (8), a BA radiation element, a BB radiation element, an A feeder line, a B feeder line, a C feeder line, a D feeder line, a first sensor, a second sensor, a third sensor and a fourth sensor;

wherein the AA radiation element and the AB radiation element have an identical structure with respect to each other and form the bow-tie antenna;

wherein the BA radiation element and the BB radiation element have an identical structure with respect to each other and form the fine-and-straight antenna;

wherein the AA radiation element, the BA radiation element, the A feeder line, the B feeder line are provided on an upper plate of the dielectric slab by a copper pouring process; wherein a copper covering thickness thereof is 0.018-0.035 mm;

wherein the AB radiation element, the BB radiation element, the C feeder line and the D feeder line are provided on a lower plate of the dielectric slab by a copper pouring process, wherein another copper covering thickness thereof is 0.018-0.035 mm;

wherein an A isolation groove is provided on the AA radiation element, the A isolation groove does not have a copper covering layer; a first sensor and a second sensor are respectively provided on two ends of the A isolation groove;

wherein a B isolation groove is provided on the AB radiation element, the B isolation groove does not have a cooper covering layer; a third sensor and a fourth sensor are respectively provided on two ends of the B isolation groove;

wherein said AA, AB, BA, BB, A, B, C and D are individual elements such that they each have a respective structure.

2. The out-of-band coupled antenna combined by the fine-and-straight antenna and the bow-tie antenna, as recited in claim 1, wherein the A isolation groove and the B isolation groove are respectively provided on a three-quarter distance between an upper bottom edge and a lower bottom edge of the AA radiation element and the AB radiation element.

3. The out-of-band coupled antenna combined by the fine-and-straight antenna and the bow-tie antenna, as recited in claim 1, wherein the out-of-band coupled antenna has a wavelength at a range of 50 mm-5000 mm as a size constraint.

4. The out-of-band coupled antenna combined by the fine-and-straight antenna and the bow-tie antenna, as recited in claim 3, wherein a size constraint of the out-of-band coupled antenna is:

$a_1=(0.8\sim1.5)\ \lambda$, $b_1=(0.4\sim0.8)\ \lambda$;

$a_{2upper}=a_{8upper}=(0.005\sim0.01)\ \lambda$, $a_{2lower}=a_{8lower}=1.15\ b_2$, $b_2=b_8=(0.1\sim0.2)\ \lambda$, $a_{2groove}=a_{8groove}=(0.005\sim0.01)\ \lambda$, $b_{2cut}=\frac{3}{4}\ b_2$, $b_{8cut}=\frac{3}{4}\ b_8$;

$a_3=a_9=(0.005\sim0.01)\ \lambda$, $b_3=b_9=(0.2\sim0.3)\ \lambda$;

$a_4=a_5=a_6=a_7=(0.25\sim0.5)\ \lambda$;

$b_4=b_5=b_{6upper}=b_{7upper}=0.0075\lambda$;

$b_{7lower}=b_{6lower}=0.03\lambda$;

$b_{4\text{-}5}=b_{6\text{-}7}=(0.3\sim0.5)\ \lambda$.

5. The out-of-band coupled antenna combined by the fine-and-straight antenna and the bow-tie antenna, as recited in claim 1, wherein the AA radiation element and the AB radiation element are in a shape of a trapezoidal and particularly an isosceles trapezoidal.

6. The out-of-band coupled antenna combined by the fine-and-straight antenna and the bow-tie antenna, as recited in claim 1, wherein the AA radiation element and the AB radiation element are in a shape of an isosceles trapezoidal.

7. The out-of-band coupled antenna combined by the fine-and-straight antenna and the bow-tie antenna, as recited in claim 1, wherein a value the first sensor, the second sensor, the third sensor and the fourth sensor adopted by the out-of-band coupled antenna is at a range of 2.2 nH.

8. The out-of-band coupled antenna combined by the fine-and-straight antenna and the bow-tie antenna, as recited in claim 1, wherein a feeding mode of the out-of-band coupled antenna is side-fed.

* * * * *